US007112103B2

(12) United States Patent
Zhang et al.

(10) Patent No.: US 7,112,103 B2
(45) Date of Patent: Sep. 26, 2006

(54) ELECTRICAL CONNECTOR HAVING RELIABLE CONTACTS

(75) Inventors: Hongbo Zhang, Kunsan (CN); Wei-Ya Cheng, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/968,325

(22) Filed: Oct. 18, 2004

(65) Prior Publication Data

US 2005/0085136 A1 Apr. 21, 2005

(30) Foreign Application Priority Data

Oct. 17, 2003 (TW) ..... 92218496 U

(51) Int. Cl.
*H01R 13/24* (2006.01)

(52) U.S. Cl. ..... 439/700; 439/824

(58) Field of Classification Search ..... 439/700, 439/824, 884, 864, 805, 862; 324/761, 754, 324/72.5

See application file for complete search history.

(56) References Cited

U.S. PATENT DOCUMENTS 4,664,458 A * 5/1987 Worth ..... 439/82
5,259,769 A * 11/1993 Cruise et al. ..... 439/65
5,308,252 A * 5/1994 Mroczkowski et al. ..... 439/66
6,077,130 A * 6/2000 Hughes et al. ..... 439/862
6,241,535 B1 * 6/2001 Lemke et al. ..... 439/83
6,312,295 B1 11/2001 Nishimatsu
6,315,576 B1 * 11/2001 Neidich ..... 439/66
6,524,140 B1 2/2003 Takagi et al.
6,685,512 B1 * 2/2004 Ooya ..... 439/630

* cited by examiner

*Primary Examiner*—Alexander Gilman
(74) *Attorney, Agent, or Firm*—Wei Te Chung

(57) ABSTRACT

An electrical connector (100) is provided for mating with a mating connector and includes an insulator (21) having a plurality of passageways (213) defined therein and a number of conductive contacts (22) received in the passageways. Each conductive contact includes a rear fixing portion (221), a front contacting arm (224) projecting beyond the insulator and a spring portion (223) elastically connecting the contacting arm to the fixing portion. The contacting arm has a pair of contacting fingers (225) angled outwardly in a front end thereof. The spring portion is flexed to permit the contacting arm to move in a first direction. Simultaneously, the contacting fingers are forced to move outwardly in a second direction perpendicular to the first direction and wipe along mating contacts 5 of the mating connector.

5 Claims, 3 Drawing Sheets

ELECTRICAL CONNECTOR HAVING RELIABLE CONTACTS

CROSS-REFERENCE TO RELATED APPLICATION

This application is related to a U.S. patent application with unknown serial number, entitled "ELECTRICAL CONNECTOR WITH IMPROVED CONTACTS", invented by the same inventor and assigned to the common assignee as the present invention. The disclosure of the co-pending application is wholly incorporated herewith by reference.

BACKGROUND OF THE INVENTION

1. Field of the Invention

The present invention generally relates to the art of electrical connectors and more particularly, to an electrical connector having a contact element for elastically movable connecting with a complementary electrical connector.

2. Description of the Prior Art

Spring contacts for electrical interfaces are well known in the prior art and represent a wide family of technology for providing interconnection between electrical contact elements. A known type of such a conventional connector is disclosed in U.S. Pat. No. 6,524,140 B2 issued to Takagi et al. on Feb. 25, 2003. The Takagi connector comprises an insulator and a plurality of conductive contacts received in the insulator. Each contact includes a contacting arm having a contact point extending beyond a mating opening of the insulator, and a spring portion integrally formed with the contacting arm. The insulator has a stopper portion adjacent to the mating opening thereof for elastically pressing a lower portion of the spring portion inwardly, thereby maintaining the contacting arm in a normal downwardly inclined state. When the connector mates with a complementary connector, the contacting arm of each contact is depressed inwardly and is free from the pressing of the stopper portion of the insulator, thereby moving upwardly relative to the complementary connector. As a result, the contacting arm upwardly goes back to a horizontal state.

However, being always pressed by the stopper portion of the housing, the spring portions of the contacts of the Takagi connector may be distorted or become robustless after repeatedly mating with the complementary connector, thus the contacts can not electrically and reliably connect with mating contacts of the complementary connector. Moreover, it is desired that the contacting portions be clean and having a low contact resistance. The Takagi contacts move from the inclined position to the horizontal position to provide the so-called "wiping effect". Due to elastic distortion of the Takagi contacts, a distance between inclined position and the horizontal position will be decreased, thus rendering unsatisfied wiping effects.

Hence, an electrical connector having reliable contacts is desired to overcome the foregoing shortcomings.

BRIEF SUMMARY OF THE INVENTION

An object of the present invention is to provide an electrical connector having improved contacts capable of providing large wiping effects upon plugging.

An electrical connector is provided for mating with a mating connector and includes an insulator having a plurality of passageways defined therein and a plurality of conductive contacts received in the passageways. Each conductive contact includes a rear fixing portion, a front contacting arm projecting beyond the insulator and a spring portion elastically connecting the contacting arm to the fixing portion. The contacting arm has a pair of contacting fingers angled outwardly in a front end thereof. The spring portion is flexed to permit the contacting arm to move rearwardly or in a first direction. Simultaneously, the contacting fingers are forced to move outwardly in a second direction perpendicular to the first direction and wipe along mating contacts of the mating connector.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures.

DETAILED DESCRIPTION OF THE INVENTION

Figure 1:
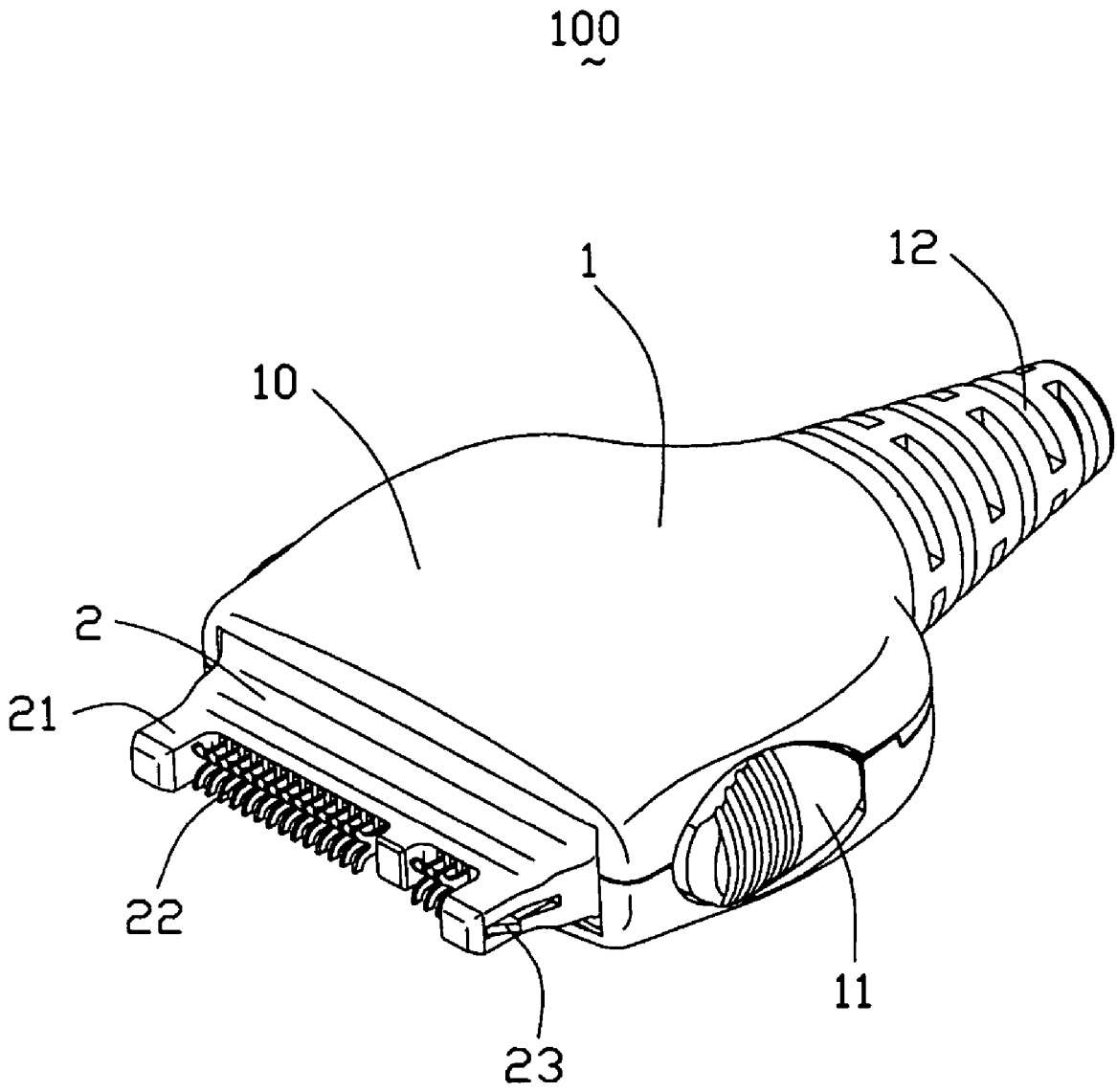
FIG. 1 is a perspective view of an electrical connector according to the present invention.

Referring to the drawings in greater detail, and first to FIG. 1, the invention is embodied in an electrical connector, generally designated 100, which is adapted for mating with a mating connector. The electrical connector 100 comprises a dielectric casing 1 and a connector module 2 received in the dielectric casing 1. The dielectric casing 1 includes a base portion 10, a pair of buttons 11 positioned in opposite sides of the base portion 10, and a cable holder portion 12 extending rearwardly from the base portion 10 for holding a cable therein. However, it should be understood that various features of the invention are equally applicable for other types of connectors, as will be fully understandable from the following detailed description.

Figure 2:
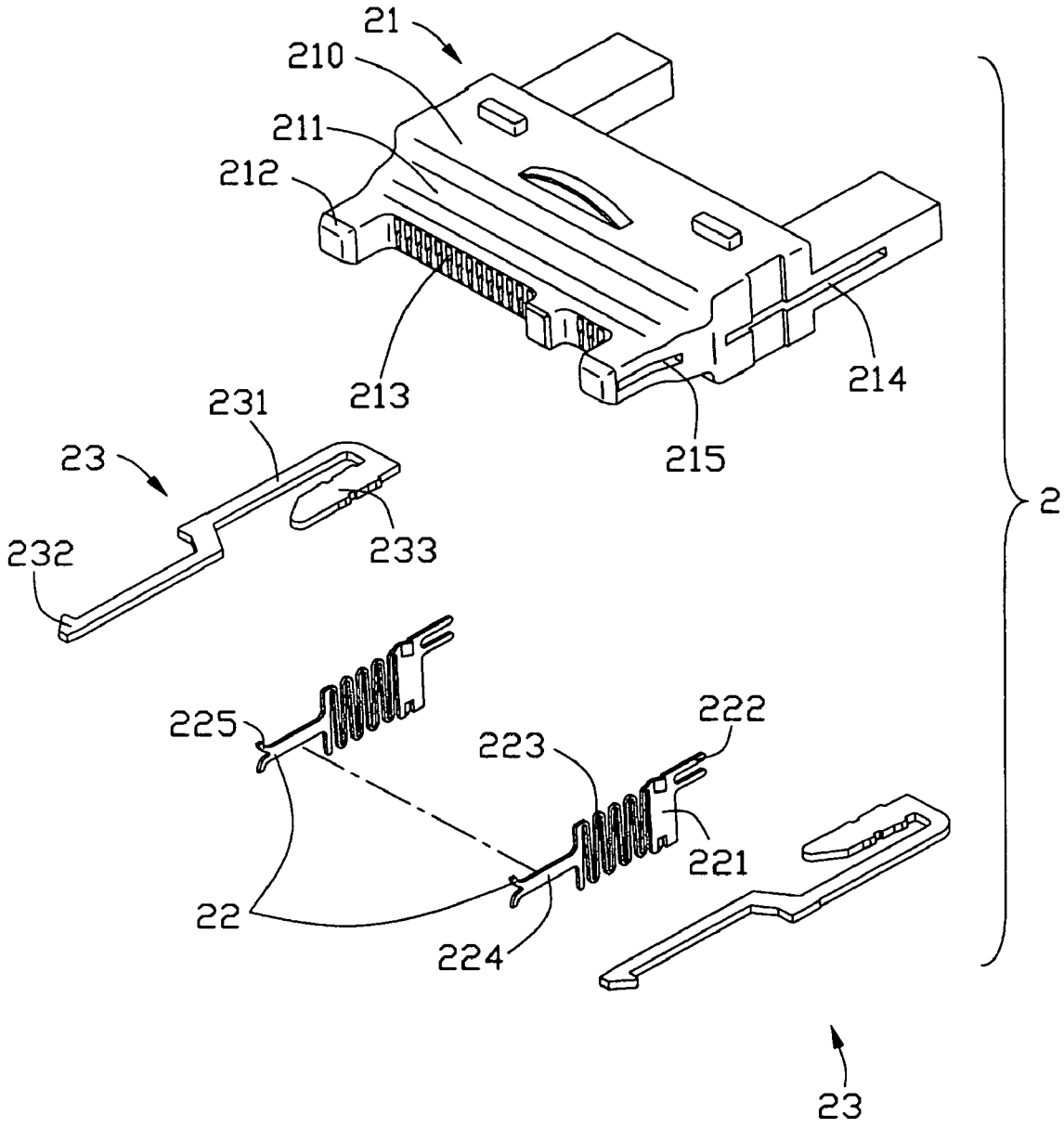
FIG. 2 is an exploded view of a connector module of the electrical connector.
Figure 3:
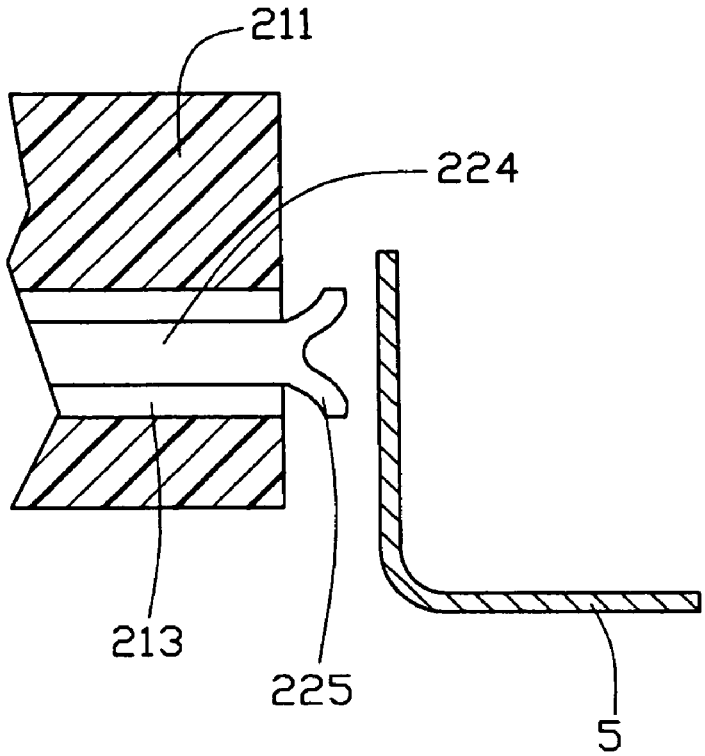
FIG. 3 is a partially sectional enlarged view of the connector module illustrated in FIG. 2 before connection with a mating connector.

Referring to FIGS. 2 and 3 and in conjunction with FIG. 1, the connector module 2 comprises an insulator 21 partially projecting out of the dielectric casing 1, a plurality of conductive contacts 22 fixed in the insulator 21 and a pair of latching arms 23 received in the insulator 21.

The insulator 21 is a one-piece structure unitarily molded of dielectric material such as plastic or the like. The insulator 21 includes a generally U-shaped base portion 210, a mating portion 211 forwardly extending from the base portion 210 and having a front mating end (not labeled), and a pair of guiding portions 212 extending forwardly from opposite sides of the mating portion 211. A plurality of passageways 213 are spaced apart in the insulator 21 for receiving the conductive contacts 22. A pair of first grooves 214 are defined in opposite sides of the base portion 210 of the insulator 21 corresponding to the buttons 11. A pair of second grooves 215 are defined in opposite sides of the guiding portion 212 and communicate with corresponding first grooves 214.

Referring to FIGS. 2 and 3, each conductive contact 22 is vertically received in a corresponding passageway 213 and comprises a rectangular fixing portion 221, a substantially U-shaped soldering portion 222 extending rearwardly from the fixing portion 221, an elongate front contacting arm 224 for mating with the mating connector and a spring portion 223 elastically connecting the contacting arm 224 to the fixing portion 221. The spring portion 223 is formed along a longitudinal axis (not labeled) of the contact 22 and has a serpentine shape between the fixing portion 221 and the contacting arm 224. The contacting arm 224 extends forwardly from the spring portion 223 and having a longitudinal central axis (not labeled). A pair of bifurcate contacting fingers 225 are provided at a front end of the contacting arm 224 and elastically and vertically lie on respective side of the longitudinal central axis. The contacting fingers 225 are mirror images about the longitudinal central axis of the contacting arm 224 and vertically outwardly angled away from the longitudinal central axis.

As best shown in FIG. 2, each latching arm 23 includes a fixing portion 233 securely retained in the insulator 21, a resilient driving portion 231 and a latching portion 232 integrally and forwardly extending from the driving portion 231.

Referring to FIGS. 1, 2 and 3, in assembly, the conductive contacts 22 are received in respective ones of the passageways 213 with the contacting fingers 225 of the contacting arms 224 forwardly projecting beyond the mating portion 211 of the connector body 21. The driving portions 231 and the fixing portions 233 of the latching arms 23 are positioned in the first grooves 214 of the insulator 21. The driving portions 231 partially projects beyond the first groove 214 for engaging with corresponding buttons 11. A front portion of the driving portion 231 of each latching arm 23 extends into the second groove 215 of the insulator 21. The latching portion 232 extends forwardly beyond the second groove 215 of the insulator 21 for engagement with appropriate latch means of the mating connector. The assembled connector module 2 is assembled to the dielectric casing 1.

Figure 4:
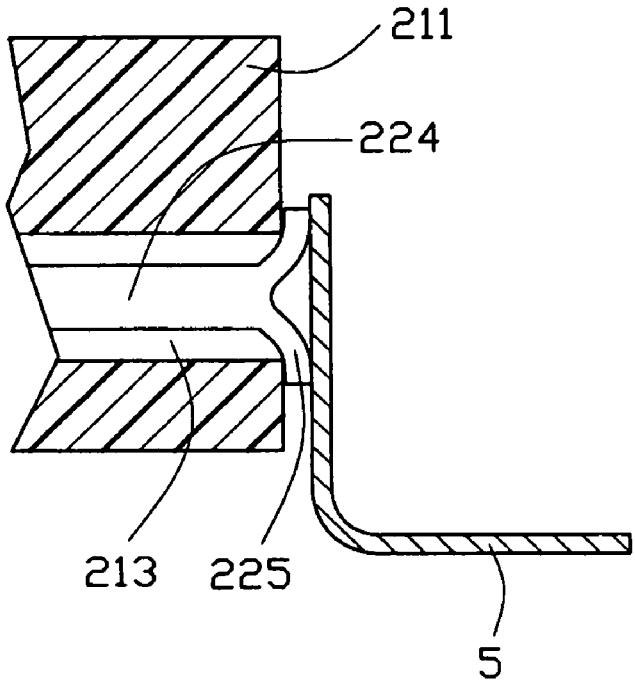
FIG. 4 is a partially sectional enlarged view of the connector module illustrate in FIG. 2 at the completion of connection with the mating connector.

Referring to FIGS. 3 and 4 in conjunction with FIGS. 1 and 2, when the electrical connector 100 mates with the mating connector, the buttons 11 are inwardly pressed and urge the driving portions 231 of the latching arms 23 to move inwardly, thereby rendering the latching portions 232 received in the second grooves 215 of the insulator 21 and allowing the mating occurs. The contacting fingers 225 of each contact 22 is rearwardly pressed by mating contacts 5 of the mating connector, and the spring portion 223 is flexed to permit the contacting arm 224 to move rearwardly or in a first direction. Simultaneously, the contacting fingers 225 are forced to move outwardly in a second direction perpendicular to the first direction and wipe along the mating contacts 5 of the mating connector to achieve their final mated positions. In moving initial positions to final positions shown in FIGS. 3 and 4, the contacting fingers 225 of each contacts 22 slide along the mating contact 5 and an angle between the contacting fingers 225 are increased to provide adequate wipe. When the mating completed, the driving portions 231 are released and urge the buttons 11 move outwardly, thereby the latching portion 232 of the electrical connector 100 respectively engaging with counterpart locking portions of the mating connector to secure the electrical connector 100 to the complementary connector.

To disengage the electrical connector 100 from the mating connector, the buttons 11 are inwardly depressed, the driving portions 231 of the latching arms 23 are inwardly moved, thereby disengaging the latching portion 232 from the mating connector and releasing the electrical connector 1 from the complementary connector. The spring portions 223 of the contacts 22 are released and urge the contacting arm 224 to the normal position.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mating with a mating object, comprising:

an insulator defining a passageway therein;

a conductive contacting arm having a pair of bifurcate contacting fingers formed at one end thereof for receiving a mating force from the mating object in a first direction; and a spring portion movable received in the passageway and supporting the contacting arm so that the contacting fingers are elastically movable in the first direction;

said bifurcate contacting fingers being mirror-imaged arranged relative to a longitudinal axis of the conductive contacting arm and projecting beyond the passageway and defining an angle therebetween, the angle being expandable during mating with the mating object; wherein the spring portion has a serpentine shape and extends in a rear-to-front direction.

2. The electrical connector according to claim 1, wherein the insulator has a front mating end, and wherein the contacting fingers forwardly project beyond the front mating end in a normal position.

3. The electrical connector according to claim 1, wherein the spring portion is electroconductive and is elastically connected to the contacting arm.

4. An electrical connector assembly comprising:

an insulative housing defining at least one passageway extending in a lengthwise direction;

a contact disposed in said at least one passageway extending through a face of the housing, said contact including an elongated contacting arm extending along said passageway, and a laterally extending curved contacting finger located at a distal end of said contacting arm and exposed to an exterior outside of the front face of the housing; and a mating contact approaching to the front face from the exterior in said lengthwise direction and abutting against the contacting finger; wherein when mated, the contacting finger is outwardly, in a lateral direction perpendicular to said lengthwise direction, deformed by said mating contact to abut against the front face of the housing so as to be sandwiched between the front face of the housing and the mating contact; when unmated, the contacting finger is retracted in the lateral direction to be capable of passing through the passageway during assembling the contact to the housing from a rear face of the housing to the front face.

5. The assembly as claimed in claim 4, wherein when mated, said contacting arm is slightly moved backward in said lengthwise direction but not in said lateral direction.

* * * * *